US005888125A

United States Patent [19]

Kuehn

[11] Patent Number: 5,888,125

[45] Date of Patent: Mar. 30, 1999

[54] ABRASIVE BLAST WHEEL WITH IMPROVED SERVICEABILITY

[75] Inventor: Udo Kuehn, Holland, Ohio

[73] Assignee: B&U Corporation, Adrian, Mich.

[21] Appl. No.: 965,427

[22] Filed: Nov. 6, 1997

[51] Int. Cl.[6] ..... B24C 5/06

[52] U.S. Cl. ..... 451/95; 451/97; 451/98

[58] Field of Search ..... 241/275; 415/115; 416/179, 233, 214 R, 214 A, 219 R, 219 A, 220 R, 220 A, 223 A; 451/75, 89, 91, 94, 95, 96, 97, 98

[56] References Cited

U.S. PATENT DOCUMENTS

| | | | |
|---|---|---|---|
| D. 579,091 | 6/1998 | MacMillan | 451/95 |
| 2,108,006 | 2/1938 | Keefer . | |
| 2,352,588 | 6/1944 | Rosenberger et al. . | |
| 2,732,666 | 1/1956 | Powell . | |
| 3,319,383 | 5/1967 | Bowling, Jr. et al. . | |
| 5,577,953 | 11/1996 | MacMillan | 451/95 |

*Primary Examiner*—Timothy V. Eley
*Attorney, Agent, or Firm*—Harness, Dickey & Pierce, P.L.C.

[57] ABSTRACT

In accordance with the teachings of the present invention, an abrasive blast wheel is assembled for cleaning work pieces with abrasive materials. The blast wheel assembly is simplified by securing the blades about the impeller by inserting them into slots in a blade supporting wheel and retaining them therein with a retaining ring that extends over the outer edge of the wheel. Removal and subsequent replacement of the blades is thus simplified because all of the blades may be removed simultaneously by merely removing the retaining ring.

8 Claims, 5 Drawing Sheets

ABRASIVE BLAST WHEEL WITH IMPROVED SERVICEABILITY

BACKGROUND OF THE INVENTION

1. Field of the Invention

The present invention relates to abrasive blast wheels for cleaning work pieces and more specifically, to a simplified assembly that allows for easier replacement of worn throwing blades, while minimizing the number of components.

2. Description of the Prior Art

Abrasive blast wheels are typically used to deliver abrasive materials at high velocities onto a work piece in order to clean the work piece. The blast wheels are rotationally driven by a motor or other rotational driving device capable of attaining the high speed rotation required in order to properly clean the targeted work piece. Blast wheels generally include several vanes or blades that attach to an impeller or mounting plate. In general, the blades must be a separate component because they must be replaced periodically due to excessive wear caused by the abrasive materials.

A typical blast wheel includes a mounting plate for securing the blades. In general, the prior designs require either a specific tool for removing and replacing the blades, or additional components that cooperate to lock the blade in place. For example, a pin or lug may be inserted into the mounting plate after the blade is installed to prevent radially outward movement of the blades. In general, such designs are either difficult to service or are costly due to the fact that they require additional components.

Another type of blast wheel secures the blades to a mounting plate by inserting the blades from the center of the wheel radially outward into the mounting plate. The mounting plate includes a ridge that prevents further outward movement of the blades. Radially inward movement is then prevented by an additional inner component that contacts the innermost portion of the blade to secure it to the mounting plate. Such a design is again difficult to service due to the fact that a number of components, such as the impeller and supply spout that supplies the abrasive material, must be removed to provide enough clearance to remove the blades.

Other blast wheels attempt to simplify the service process by sliding the blades radially inward into slots on the mounting plate. The blades are then secured by an additional hub component that prevents radially outward movement of the blades while also allowing them to be removed. The hub includes a slot and may be rotated relative to the mounting plate such that the slot aligns with a blade, thereby allowing that particular blade to be removed from the plate. This design reduces the number of components required to secure the blades but requires that each blade be removed one at a time. Each time a blade is replaced, the hub must be rotated until it aligns with the next blade to be removed.

In view of the foregoing limitations and shortcomings of the prior art devices, as well as other disadvantages not specifically mentioned above, it should be apparent that there still exists a need in the art for an improved abrasive blast wheel which is inexpensive to make and easy to replace the worn blades.

It is therefore a primary object of this invention to fulfill that need by providing an abrasive blast wheel that provides a more efficient replacement process for replacing worn blades.

It is another object of this invention to provide a blast wheel that allows multiple blades to be removed and replaced simultaneously.

It is a further object of this invention to provide a blast wheel that requires fewer components for retaining the throwing blades within the assembly.

It is another object of this invention to secure the blades without any screws or pins attaching them to the assembly.

It is yet another object of this invention to secure all the blades with one continuous ring that is easily removed from the blast wheel.

SUMMARY OF THE INVENTION

Briefly described, these and other objects are accomplished according to the present invention by providing an abrasive blast wheel assembly that includes a wheel component, a blade retaining ring and several separate blades. The wheel component has radial slots opening at the outer edge of the wheel into which the blades are inserted in a radially inward direction. The retaining ring has a continuous circumferential flange and is secured to the wheel component by several fasteners. Once secured to the wheel, the flange extends axially over the outer edge of the wheel and secures the blades within the slots by preventing radially outward movement of the blades. Removal of the ring, and thus the removal of the blades, is thereby greatly simplified due to the minimal number of fasteners securing the components together. Once the retaining ring is removed, any or all of the blades may be easily removed from their respective slots in the wheel. The removal of the blades can thus be accomplished without dismantling the center components, such as the impeller or supply spout.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 1:
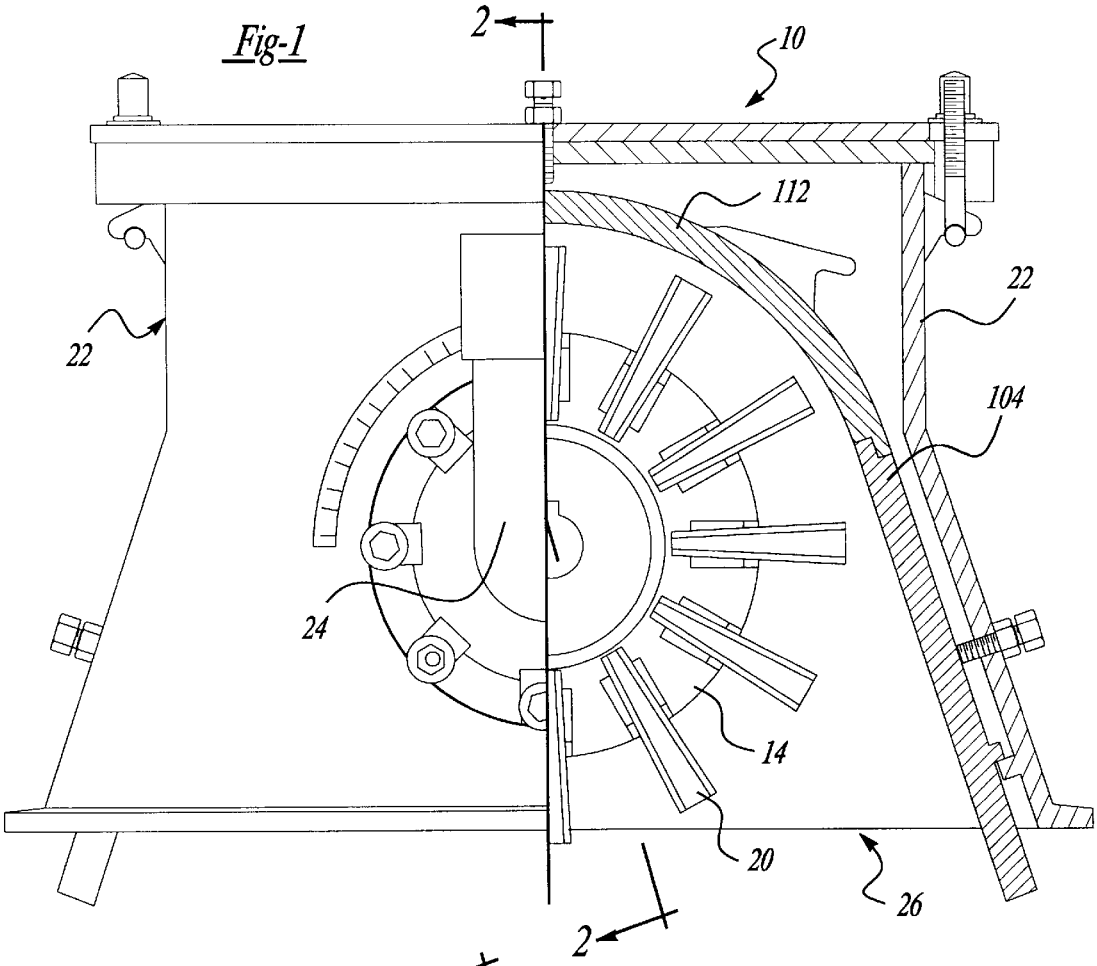
FIG. 1 is an end view of the blast wheel assembly of this invention broken away to show the inner components of the blast wheel assembly.
Figure 2:
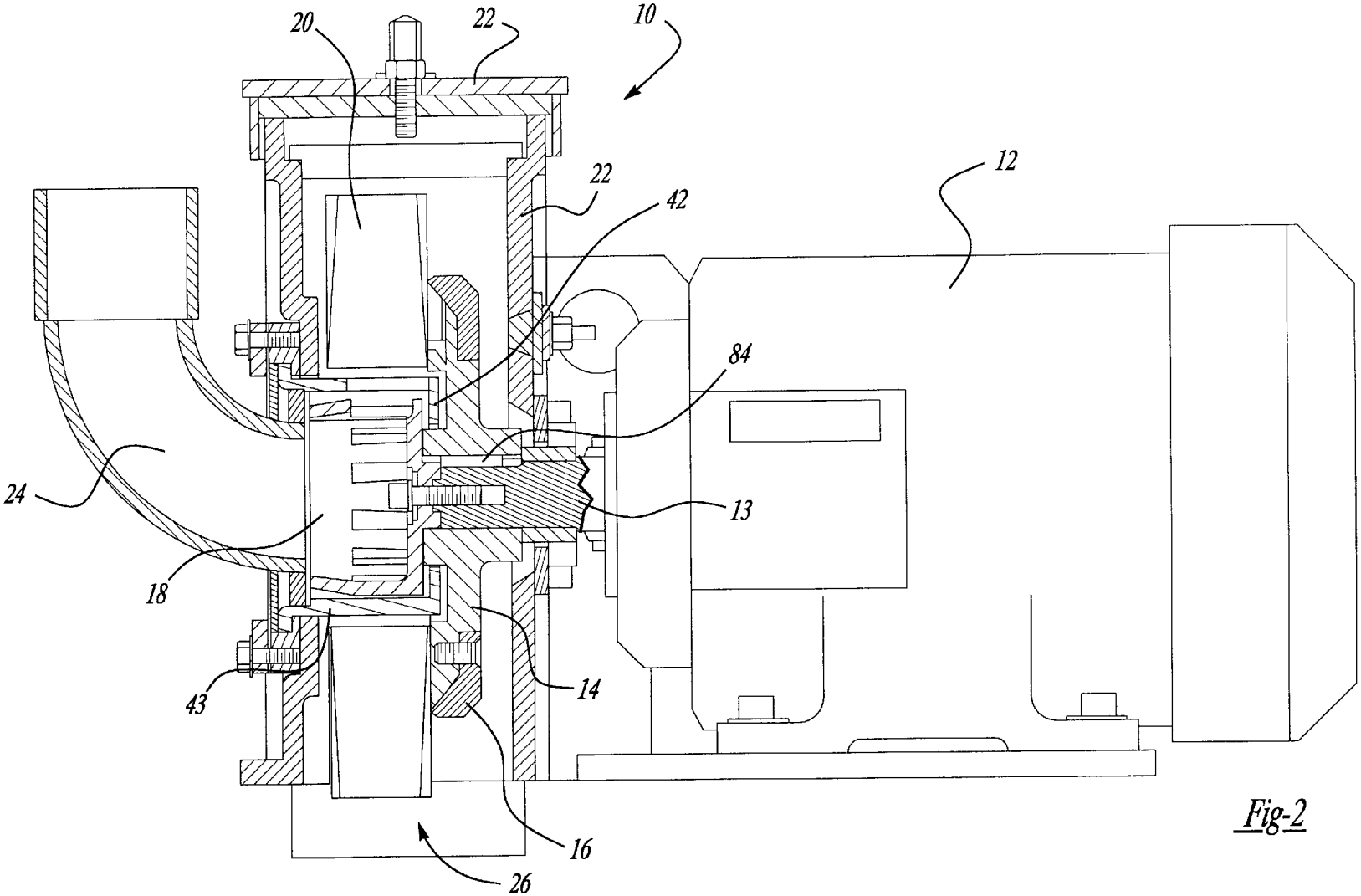
FIG. 2 is a cross-sectional view of the blast wheel assembly taken substantially along line 2—2 in FIG. 1.
Figure 3:
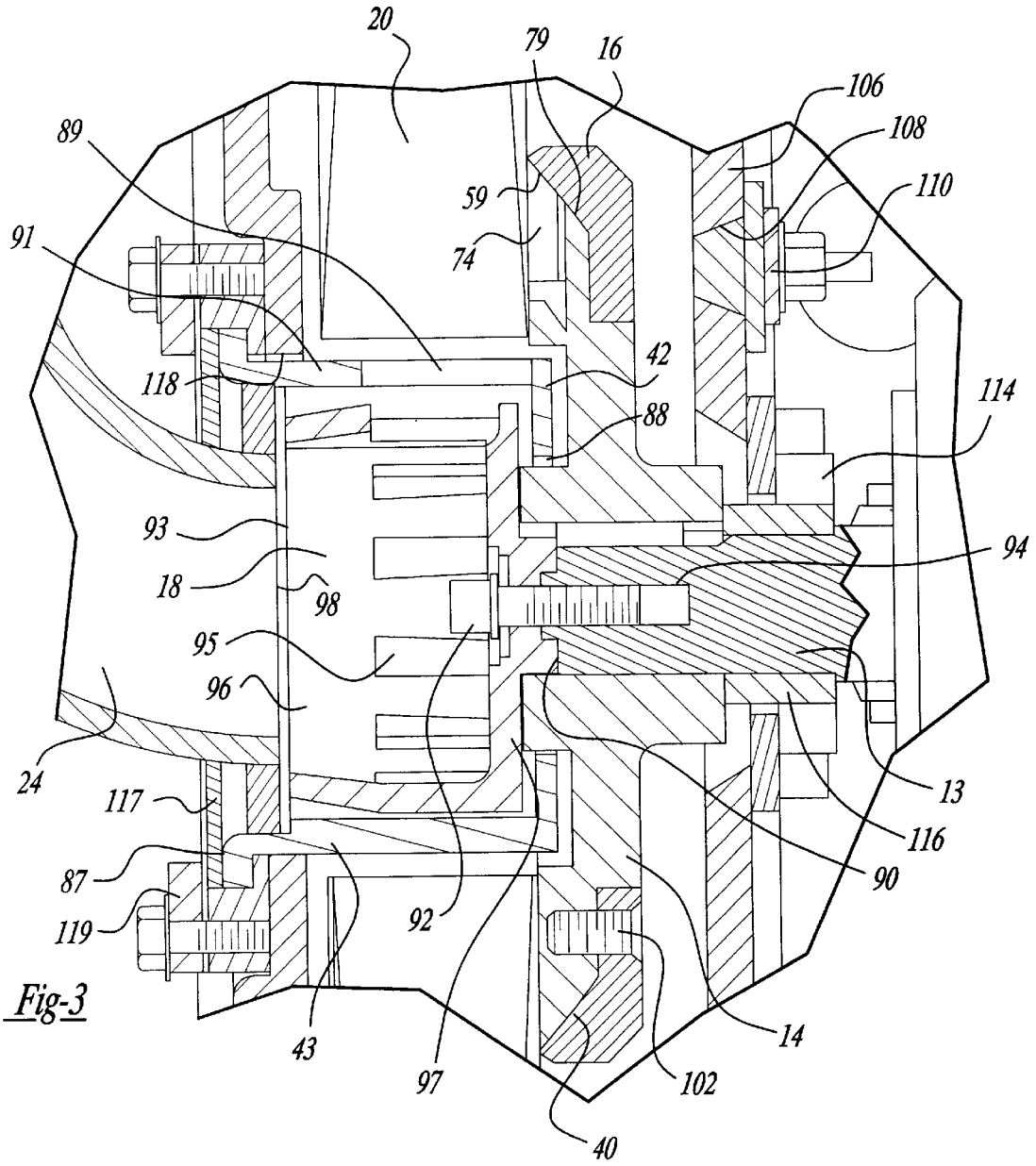
FIG. 3 is an enlarged sectional view of the center portion of the blast wheel assembly shown in FIG. 2.

Referring now in detail to the drawings, there is shown in FIGS. 1, 2 and 3 a blast wheel assembly 10 comprising a motor or other rotational driving device 12 with a rotational output shaft 13, a blade supporting wheel 14, a blade retaining ring 16, an impeller 18, and a plurality of blades or vanes 20. The assembly 10, except for the motor 12, is enclosed in a housing assembly 22, with a supply spout 24, which acts as a means for supplying abrasive materials (not shown) to the assembly 10, and a discharge opening 26, through which the abrasives are discharged onto the parts to be cleaned (not shown).

Figure 4:
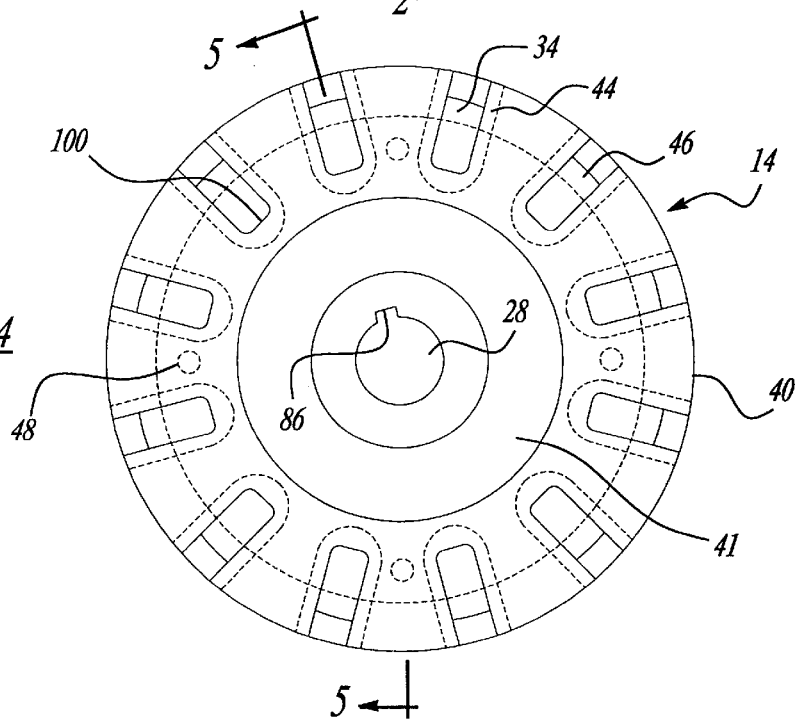
FIG. 4 is a plan view of the blade supporting wheel.
Figure 5:
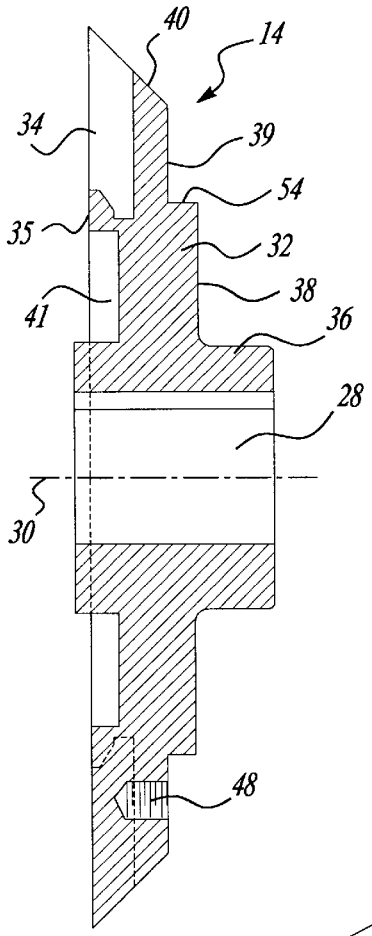
FIG. 5 is an enlarged cross-sectional view of the wheel taken substantially along line 5—5 in FIG. 4.

The blade supporting wheel 14, as further shown in FIGS. 4 and 5, is generally circular, with a bore 28 along its center axis 30. The outer portion 32 of the support wheel 14 includes a plurality of slots 34 which support the blades 20 along the slotted face 35 of the wheel 14. This outer portion 32 is axially narrower than the center portion 36 of the support wheel 14. On the opposite face 38 from the slots 34, a circumferential ring recess 39 extends around the outer edge 40 of the support wheel 14. This ring recess 39 has an inner annular edge 54 and generally corresponds with the shape of the retaining ring 16, as discussed below. Also, radially inward from the slots 34 is a cage recess 41 which accommodates one end 42 of a control cage 43 when the blast wheel 10 is assembled. The outer circumferential edge 40 is inclined away from the ring recess 39.

Extending radially outward from an inner end 100 to the outer edge 40 of the support wheel 14 are the plurality of slots 34, which are open along the outer edge 40. The slots 34 are spaced equidistantly apart and may vary in number. In the preferred embodiment, there are twelve slots 34 to accommodate twelve blades 20. Each slot 34 is undercut so that it is open along the slotted face 35 and has an inner portion 44 which is wider than the opening 46 along the slotted face 35. Finally, the support wheel includes a plurality of threaded bores 48 extending axially into the retaining ring recess 39. In the preferred embodiment, there are four threaded bores 48 located equidistantly apart around the support wheel 14. However, the number of threaded bores 48 may vary in an alternate embodiment.

Figure 7:
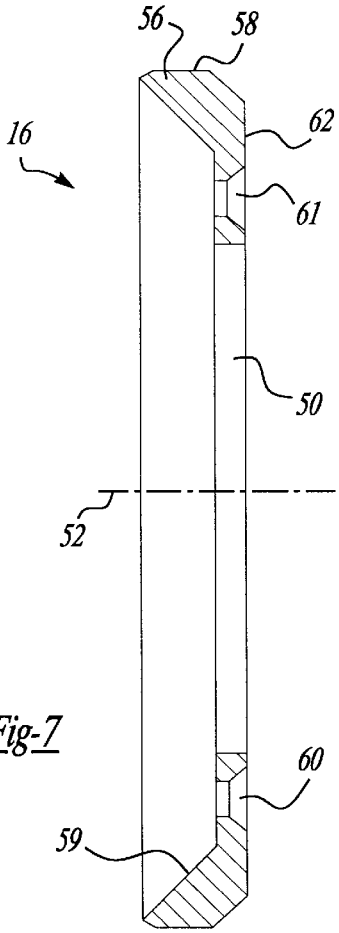
FIG. 7 is an enlarged cross-sectional view of the ring taken along line 7—7 in FIG. 6.
Figure 6:
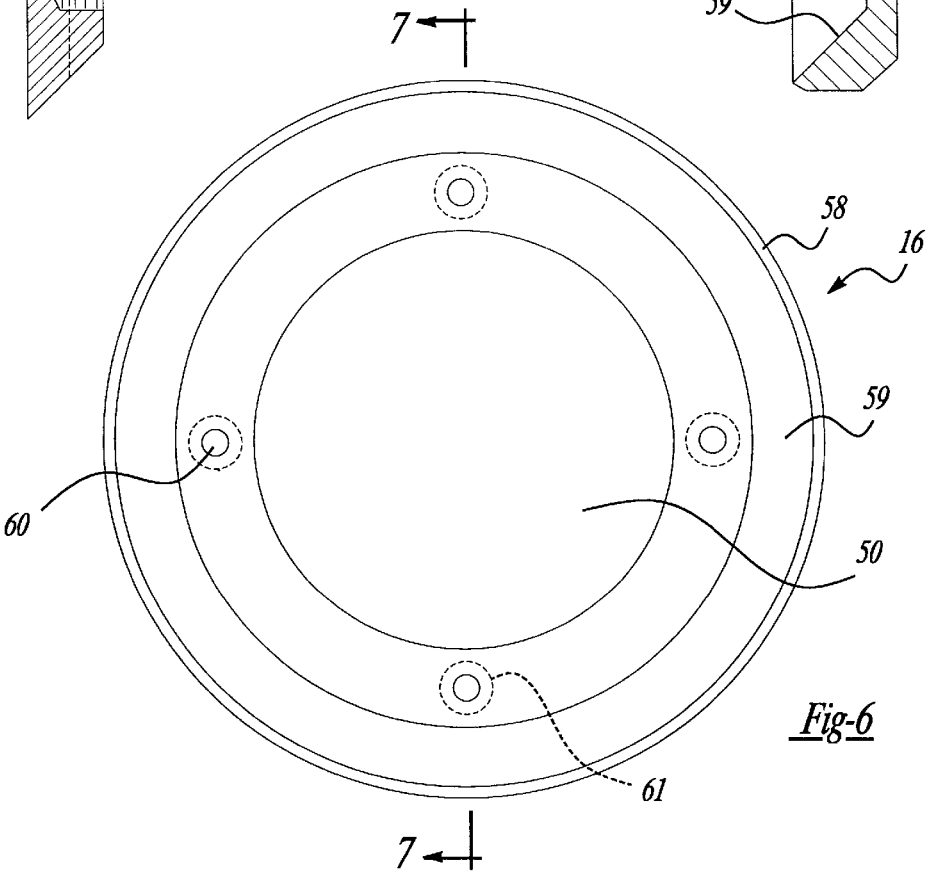
FIG. 6 is a plan view of the blade retaining ring.

The blade retaining ring 16, as further shown in FIGS. 6 and 7, is also generally circular, and includes a large bore 50 through its center axis 52. The bore 50 is generally of the same diameter as that of the inner edge 54 of the retaining ring recess 39 on the support wheel 14. The retaining ring 16 includes an axially extending flange 56 around its outer edge 58, so that the ring 16 is generally bowl-shaped and has an inner curved surface 59 defining the inner wall of the bowl. The bowl-shape of the ring 16 corresponds with the retaining ring recess 39 and inclined outer edge 40 of the support wheel 14. Finally, the retaining ring 16 includes smaller axial bores 60 that are spaced equidistantly apart around the ring 16. These smaller bores 60 correspond with the threaded bores 48 in the support wheel 14, and may include a countersunk portion 61 on the face 62 of the ring 16 that is opposite the inner curved surface 59.

Figure 8:
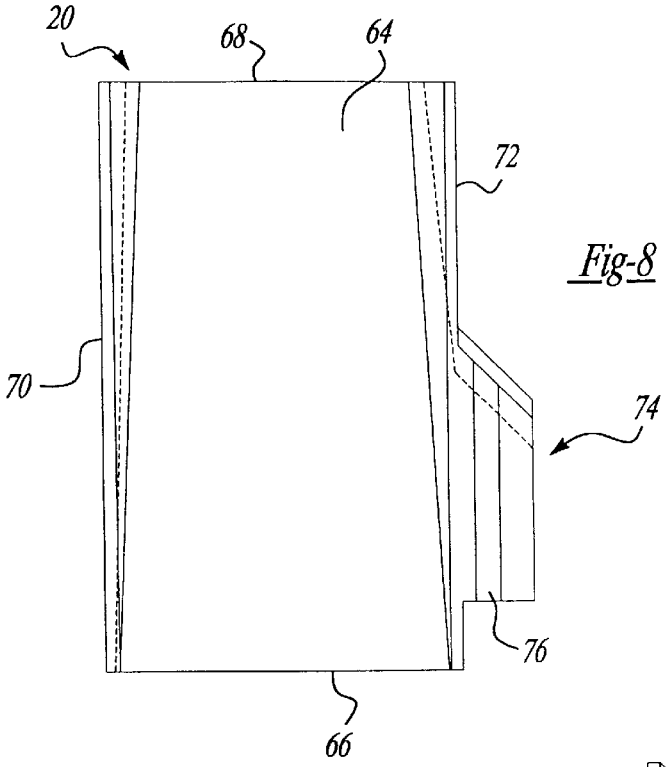
FIG. 8 is a side view of one of the blades.
Figure 9:
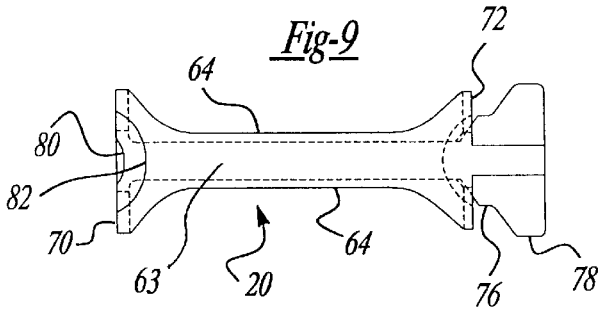
FIG. 9 is a top view of the blade shown in FIG. 8.
Figure 10:
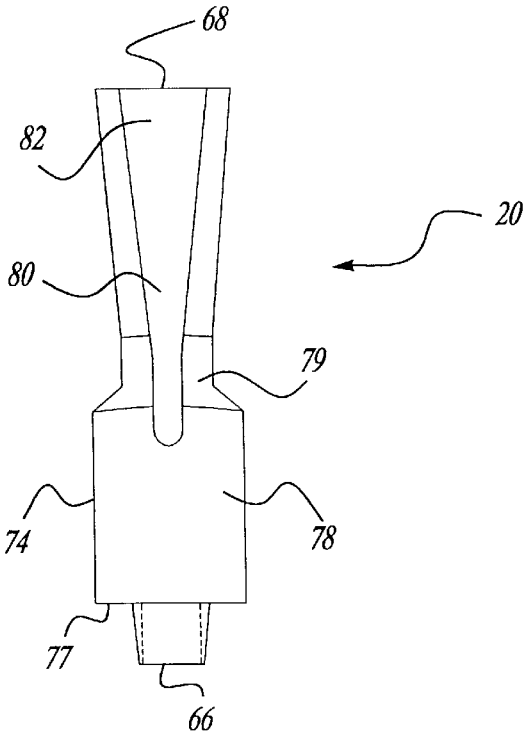
FIG. 10 is an elevated view of the blade shown in FIGS. 8 and 9.

Referring now to FIGS. 8, 9 and 10, each of the blades 20 comprises a body 63 having throwing surfaces 64, inner and outer ends 66 and 68, respectively, and radially extending side edges 70 and 72. The surfaces 64 are generally flat with the edges 70 and 72 being generally dove-tail shaped to assist in directing the abrasives in a radially outward direction when the blast wheel 10 is operating. Toward the inner end 66 of one edge 72 of the blade 20 is a base region or mounting extension 74. The mounting extension 74 has a narrow section 76 adjacent the blade edge 72 and a wider section 78 extending away from the blade 20. The resulting overall dove-tail shape of the mounting extension 74 corresponds to the slots 34 and inner portion 44 of the slots 34 on the support wheel 14. The mounting extension 74 further has a generally flat inner end 77 and a rounded outer end 79. The inner end 66 of each blade 20 is narrower than the outer end 68, as best shown in FIG. 10, with a curved recess 80 that also expands toward the outer end 68 of the blade. This curved recess 80 is best shown in FIG. 9, where the edge 70 of the blade 20 has an inner curved recess 80 at its inner end 66 and an outer curved recess 82 at its outer end 68.

The diameter of the center bore 28 of the support wheel 14 is sized so as to receive the output shaft 13 therethrough. The attachment of the support wheel 14 to the output shaft 13 is not critical to this invention. However, clearly any number of known means for attachment that prevent relative rotation between the support wheel 14 and the output shaft 13 can be applied according to the teachings of the present invention. The preferred embodiment is shown with a key or ridge 84 along the outer surface of the output shaft 13 that corresponds with a keyway 86 in the bore.

After the support wheel 14 is secured to the output shaft 13, the control cage 43 is positioned so that the center portion 36 of the support wheel 14 extends through the opening 88 at the end 42 of the cage 43. The inlet end 87 of the control cage 43 that is opposite the output shaft 13 is also open to allow the supply spout 24 to insert therethrough. The control cage 43 is secured between the housing assembly 22 and the supply spout 24 and does not contact the support wheel 14 or the impeller 18, thereby remaining stationary while the other components rotate with the output shaft 13. An opening 89 is located along the cylindrical wall 91 of the control cage that directs the abrasives from the impeller 18 onto the blades 20.

The impeller 18 is generally cylindrical and open at one end 93, with several slots 95 along its cylindrical body 96. The closed end 97 of the impeller 18 is secured to the end 90 of the output shaft 13 with a fastener 92 that inserts into a threaded hole 94 extending axially into the end 90 of the shaft 13. The closed end 97 is formed to correspond to the shape of the end 90 of the shaft 13, thereby providing the proper axial location and a contour interface between the shaft 13 and impeller 18. This eliminates the need for an intermediate center plate that is typically used in current blast wheels. The open end 93 of the impeller 18 is directed toward the supply spout 24, so that the opening 98 of the supply spout 24 corresponds therewith and supplies abrasives to the impeller 18 during operation of the blast wheel 10.

The mounting extension 74 of each blade 20 is inserted into one of the slots 34 on the support wheel 14. Because the blades 20 are inserted in a radially inward direction from outside the circumference of the support wheel 14, none of the inner components, such as the impeller 18 and control cage 43 have to be removed during installation of the blades 20. The blades 20 are inserted until the flat inner end 77 of the mounting extension 74 contacts the support wheel 14 at the radially inward end 100 of the slots 34. Each mounting extension 74 and slot 34 correspond to hold the blades 20 in place, thereby preventing radially inward movement or tangential movement of the blades 20 relative to the support wheel 14.

After the blades 20 are inserted into their respective slots 34, the blade retaining ring 16 is attached to the support wheel 14 with a plurality of fasteners 102 inserted through the smaller bores 60 in the retaining ring 16 and threaded into the threaded bores 48 in the support wheel 14. As mentioned above, the number of fasteners securing the retaining ring 16 to the support wheel 14 may vary, so long as the number of fasteners 102 is the same as the number of bores 60 in the retaining ring 16 and the number of threaded bores 48 in the support wheel 18. There are four such fasteners 102 in the preferred embodiment. Once the retaining ring 16 is secured to the support wheel 14, the flange 56 of the retaining ring 16 extends over the outer edge 40 of the support wheel 14 and also over the top end 79 of the mounting extension 74 on each blade 20. The length of the mounting extension 74 corresponds to the depth of each slot 34 so that the inner curved surface 59 of the flange 56 contacts both the top end 79 and the outer edge 40, thereby firmly securing each blade 20 within its respective slot 34.

The blades 20, support wheel 14 and other components, except the driving device 12, are encased within a liner 104 that prevents the abrasive material from discharging outward, away from the targeted piece of equipment. Outside the liner 104, the housing assembly 22 further encases the assembly 10. In order to ease the access of the fasteners 102 securing the retaining ring 16 to the support wheel 14, the side 106 of the housing includes an aperture 108 that is sealed with a plug assembly 110. The plug assembly 110 can be removed so that each fastener 102 can be accessed and removed, which then allows the retaining ring 16 to slide axially toward the driving device 12, thereby allowing removal and replacement of the blades 20. As is well known in the art, the liner 104 is removably attached to the housing assembly 22, so that removal of the liner 104 allows the top portion 112 of the liner 104 to be removed in order to access the enclosed blast wheel components. The liner 104 and housing assembly 22 further include a shaft seal 114 and bushing 116 to seal the housing 22 around the output shaft 13. A flange 117 is attached to the supply spout 24 and allows the spout 24 and the control cage 43 to be clamped together by a clamp 119, which also secures the cage 43 and spout 24 to the housing 22.

During operation, abrasive material is supplied to the blast wheel assembly through the supply spout 24. The driving device 12 rotates the output shaft 13, thereby rotating the support wheel 14, retaining ring 16, impeller 18 and blades 20, generally between 2,000 and 4,000 rpm. The abrasives are discharged through the slots 95 in the impeller 18 and then further discharged through the single opening 89 in the control cage, which directs the abrasives in a single direction onto the rotating blades 20. The abrasives move outwardly on the blades as the blades 20 rotate and are subsequently discharged at a high rate of speed out the discharge opening 26 and onto the parts to be cleaned. The remaining details of the method of operation and connection of the housing assembly are well known in the art and are not critical to the scope of the present invention.

While the above description constitutes the preferred embodiment of the present invention, it will be appreciated that the invention is susceptible to modification, variation and change without departing from the proper scope and fair meaning of the accompanying claims.

I claim:

1. A blast wheel assembly for delivering abrasive particles for cleaning work pieces, said blast wheel assembly comprising:

a rotational driving device having an output shaft;

means for supplying abrasives to said blast wheel;

a blade supporting wheel, said support wheel being of generally circular shape with an outer circumferential edge, said support wheel being attached to said output shaft such that relative rotation between said wheel and said shaft is prohibited, said wheel having a plurality of radial slots extending outward and opening at said outer edge;

a plurality of blades, each of said blades comprising a body having radial edges, an inner end and an outer end, said inner end further including a mounting extension that corresponds with said radial slots in said support wheel, said blades being removably mounted within said slots by insertion of said mounting extension into said slots in a radially inward direction so that said blades extend generally parallel with said slots, there being one blade for each said radial slot;

a blade retaining ring, said retaining ring being substantially circular and having a center bore and an outer edge, said outer edge further including a continuous circumferential flange, said ring being removably mounted to said support wheel such that said flange extends axially over said outer edge of said support wheel so as to block radially outward movement of said blades, thereby securing said blades within said slots, all of said blades being removable when said ring is removed, wherein said support wheel, said retaining ring, and said blades are enclosed within a guard housing.

2. The assembly of claim 1 wherein said retaining ring generally corresponds to a recess in said support wheel, said retaining ring being secured to said support wheel with a plurality of fasteners.

3. The assembly of claim 1 wherein said mounting extension of each of said blades having a body end at which said mounting extension joins said body and an end opposite said body end, said body end of said mounting extension being of a predetermined width and said opposite end being of a greater width, said radial slots also being of a width corresponding to said predetermined width of said body end and being of a greater width further corresponding to said greater width of said opposite end so that said mounting extensions generally correspond with said radial slots and insert therein, thereby prohibiting axial movement of said blades relative said support wheel.

4. The assembly of claim 1 wherein said mounting extension of each of said blades has an upper surface, said upper surface being rounded and sloping upward away from said retaining ring, said flange on said retaining ring having a surface corresponding to said upper surface, said upper surface and said ring surface being in surface to surface engagement.

5. The assembly of claim 1 wherein each of said mounting extensions is located along one of said radial edges of said body.

6. The assembly of claim 5 wherein said inner end of said body of each of said blades is of an inner width and said outer end of said body of each of said blades is of an outer width, said outer width being greater than said inner width.

7. The assembly of claim 1 further comprising an impeller, said impeller being mounted such that relative rotation between said impeller and said shaft is prohibited.

8. The assembly of claim 7 wherein said output shaft has an end opposite said driving device, said support wheel and said end of said shaft being configured to accept said impeller such that there is a corresponding contour interface between said impeller and said support wheel and said output shaft, said impeller secured to said end of said shaft.

* * * * *